US006645020B1

(12) United States Patent
Barker

(10) Patent No.: US 6,645,020 B1
(45) Date of Patent: Nov. 11, 2003

(54) SUBMARINE COUNTERMEASURE PROPELLER PROTECTOR

(75) Inventor: William P. Barker, Bristol, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/214,544

(22) Filed: Aug. 6, 2002

(51) Int. Cl.[7] ..... B63H 5/16
(52) U.S. Cl. ..... 440/71; 114/22; 114/238
(58) Field of Search ..... 440/71; 114/22, 114/238

(56) References Cited

U.S. PATENT DOCUMENTS 3,703,874 A * 11/1972 Lemieux ..... 114/21.1
5,452,864 A * 9/1995 Alford et al. ..... 244/3.23
6,367,401 B1 * 4/2002 Correia et al. ..... 114/238

* cited by examiner

*Primary Examiner*—Jesus D. Sotelo
(74) *Attorney, Agent, or Firm*—James M. Kasischke; Michael J. McGowan; Jean-Paul A. Nasser

(57) ABSTRACT

A propeller protector for a countermeasure vehicle having a propeller shaft, a propeller fixed to the shaft, radial fins fixed on the vehicle and extending outwardly from the shaft, and a shield fixed to the fins and surrounding the propeller. The propeller protector includes a sleeve having an end wall at a first end thereof, and an open second end engaged with the vehicle, the first end and side walls of the sleeve having perforations therein. The sleeve first end is provided with a central opening. A nut is fixed to the sleeve end wall, threadedly mounted on the shaft, and disposed around the central opening. Stop structure on the sleeve and the vehicle prevents rotation of the sleeve relative to the vehicle. Rotation of the propeller shaft unscrews the shaft from the nut, permitting the nut and the sleeve to move axially to disengage from the vehicle.

14 Claims, 4 Drawing Sheets

SUBMARINE COUNTERMEASURE PROPELLER PROTECTOR

CROSS REFERENCE TO OTHER PATENT APPLICATIONS

This patent application is with one related patent applications entitled SUBMARINE COUNTERMEASURE VEHICLE WITH FOLDING PROPELLER Ser. No. 10/214,527, by the same inventor as this application.

STATEMENT OF GOVERNMENT INTEREST

The invention described herein may be manufactured and used by and for the Government of the United States of America for Governmental purposes without the payment of any royalties thereon or therefor.

BACKGROUND OF THE INVENTION (1) Field of the Invention

The invention relates to submarine countermeasure assemblies and is directed more particularly to a propeller protector for mounting on a countermeasure vehicle.

(2) Description of the Prior Art

In FIG. 1, there is shown a typical submarine countermeasure apparatus 20. The apparatus 20 includes a launch tube 22 which, in operation, is disposed outboard of the submarine pressure hull (not shown). A countermeasure vehicle 24 is housed in the launch tube 22 and includes an array assembly 26 and a tailcone assembly 28. The tailcone assembly 28 includes an annular shield 27 surrounding a propulsion propeller 29 (FIG. 2). The array assembly 26 is protected by a surrounding sabot 30. Disposed in the launch tube 22 is a ram plate 32 and a gas generator 34. The launch tube is closed by a forward tube cover 36 and an after tube cover 38.

In operation, the gas generator 34 is activated by an electrical pulse from the submarine fire control system and generates sufficient gas pressure to move the ram plate 32 forwardly. The ram plate 32 pushes the countermeasure vehicle 24 forwardly, breaking away the forward tube cover 36 and launching the countermeasure vehicle 24 from the launch tube 22. In due course, the sabot 30 disengages from around the array assembly 26 and the array assembly is activated to emit acoustic signals.

It has been found that upon launch of the countermeasure vehicle 24, the tailcone assembly 28, and particularly the propeller 29 of the countermeasure vehicle 24, is sometimes subjected to substantial bending moments which result in propeller damage and deployment failure. The ram plate 32 pushes against the tailcone assembly 28 with a force in thousands of pounds and the bending moments on the countermeasure vehicle propeller 29, caused by water impacting the propeller as it exits the launch tube while the submarine is underway at high speeds, can be in thousands of foot pounds. While providing some protection, the shield 27 is not sufficient to protect the propeller from damage.

Accordingly, there is a need for improved propeller protection which can reduce bending moments.

SUMMARY OF THE INVENTION

An object of the invention is, therefore, to provide an improved submarine countermeasure vehicle propeller protector structured for successful launch and deployment under conditions inflicting high bending moments upon the propeller.

With the above and other objects in view, as will hereinafter appear, a feature of the present invention is the provision of a submarine countermeasure propeller protector for a countermeasure vehicle having on an after portion thereof a propeller shaft, a propeller fixed to the shaft, radial fins fixed on an after surface of the vehicle and extending outwardly from the shaft, and a shield fixed to outer edges of the fins and surrounding the propeller. The countermeasure propeller protector comprises a tubular sleeve having an end wall at a first end thereof, and an open second end adapted to be engaged with the vehicle, at least one of the end wall and side walls of the sleeve having perforations therein. The sleeve end wall is provided with a central opening therein. A nut is fixed to the sleeve end wall and is threadedly mounted on the shaft and disposed around the central opening. Stop structure on the sleeve second end and the vehicle prevent rotation of the sleeve relative to the vehicle. Rotation of the propeller shaft unscrews the shaft from the nut, permitting the nut, and thereby the sleeve, to move axially to disengage from the vehicle.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent, wherein corresponding reference characters indicate corresponding parts throughout the several views of the drawings and wherein.

DESCRIPTION OF THE PREFERRED EMBODIMENT

Figure 1:
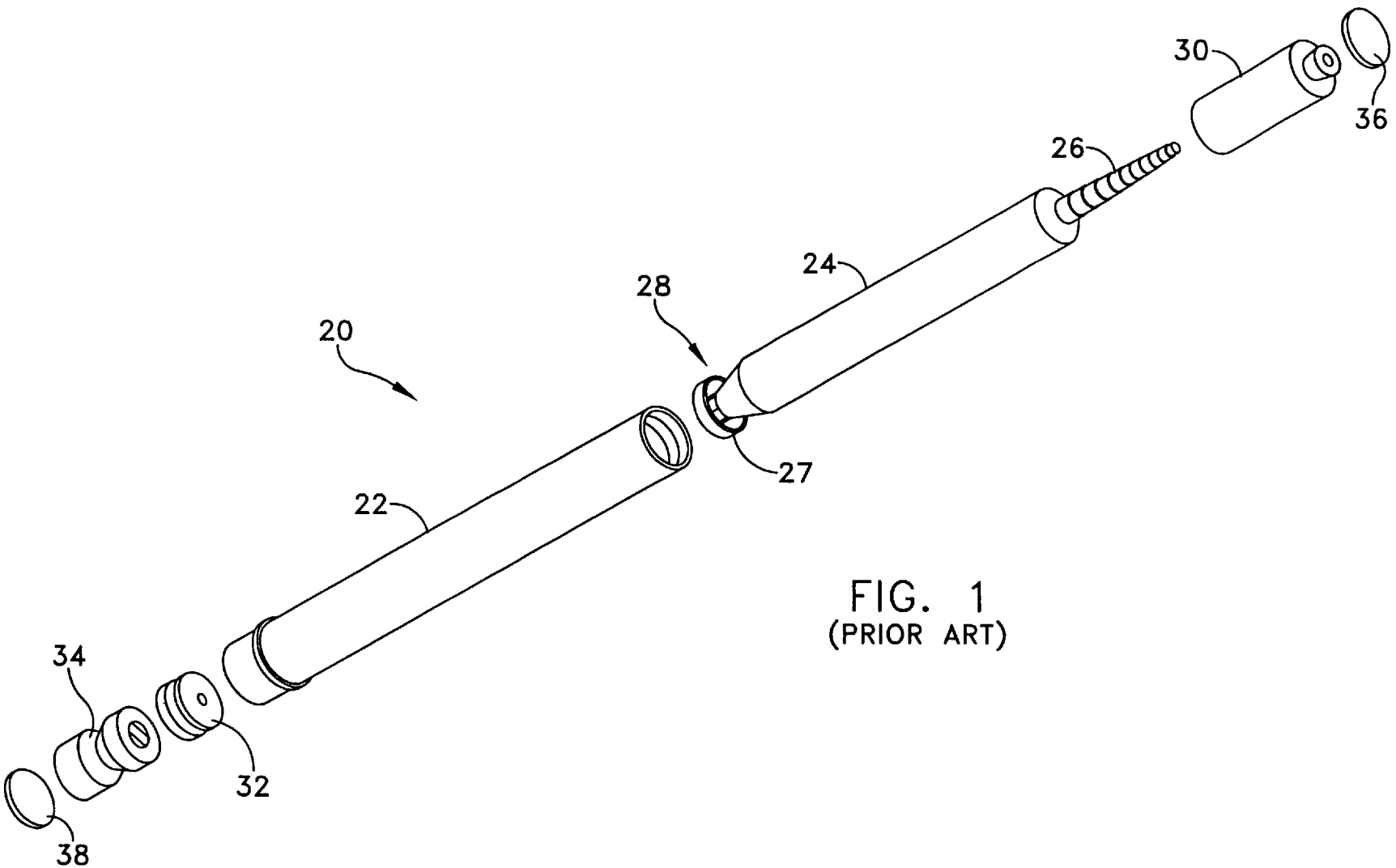
FIG. 1 (PRIOR ART)
FIG. 1 is an exploded perspective view of a prior art submarine countermeasure assembly including a propeller shield portion.
Figure 2:
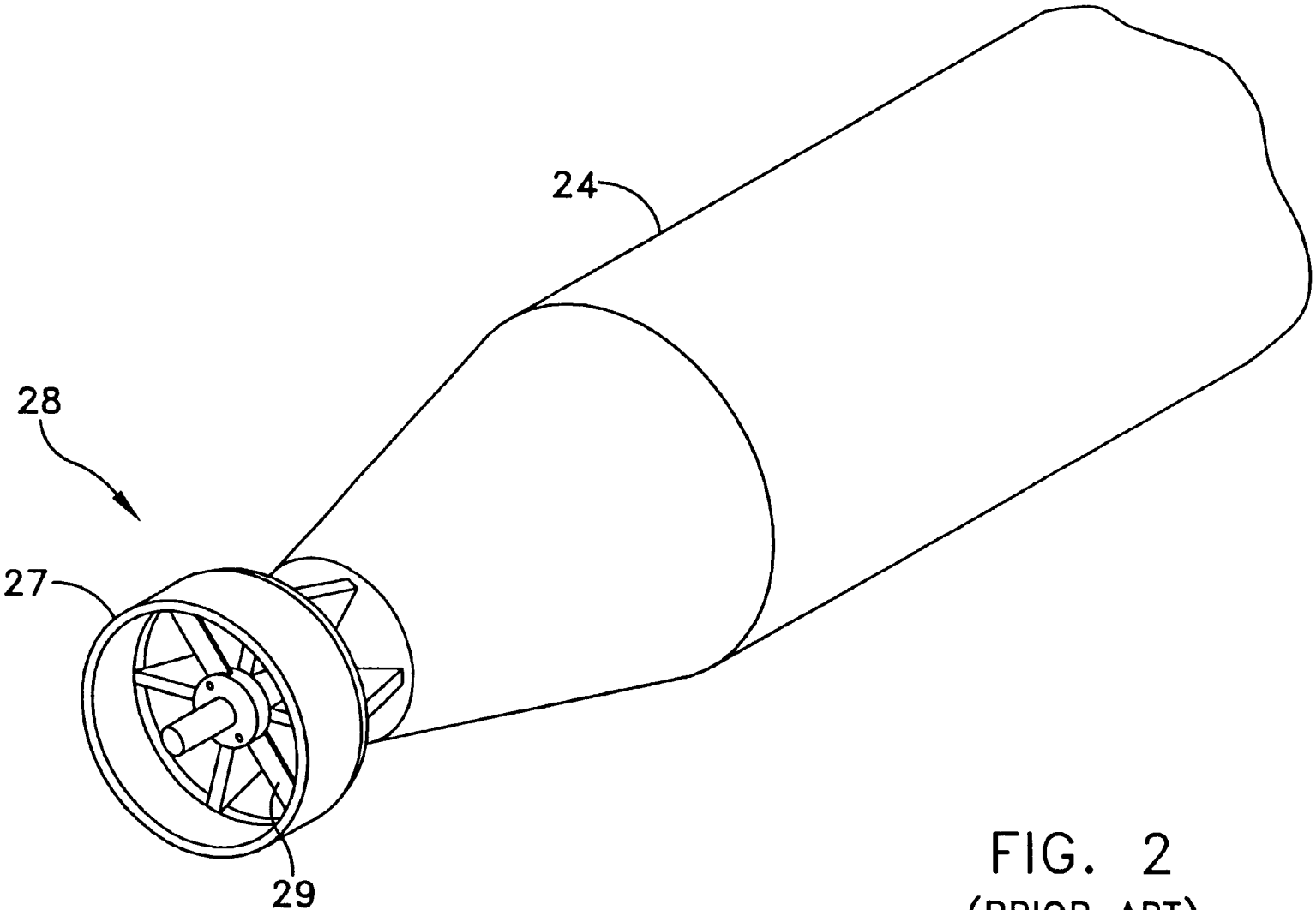
FIG. 2 (PRIOR ART)
FIG. 2 is a perspective view of a portion of the assembly of FIG. 1, including the propeller shield portion.
Figure 3:
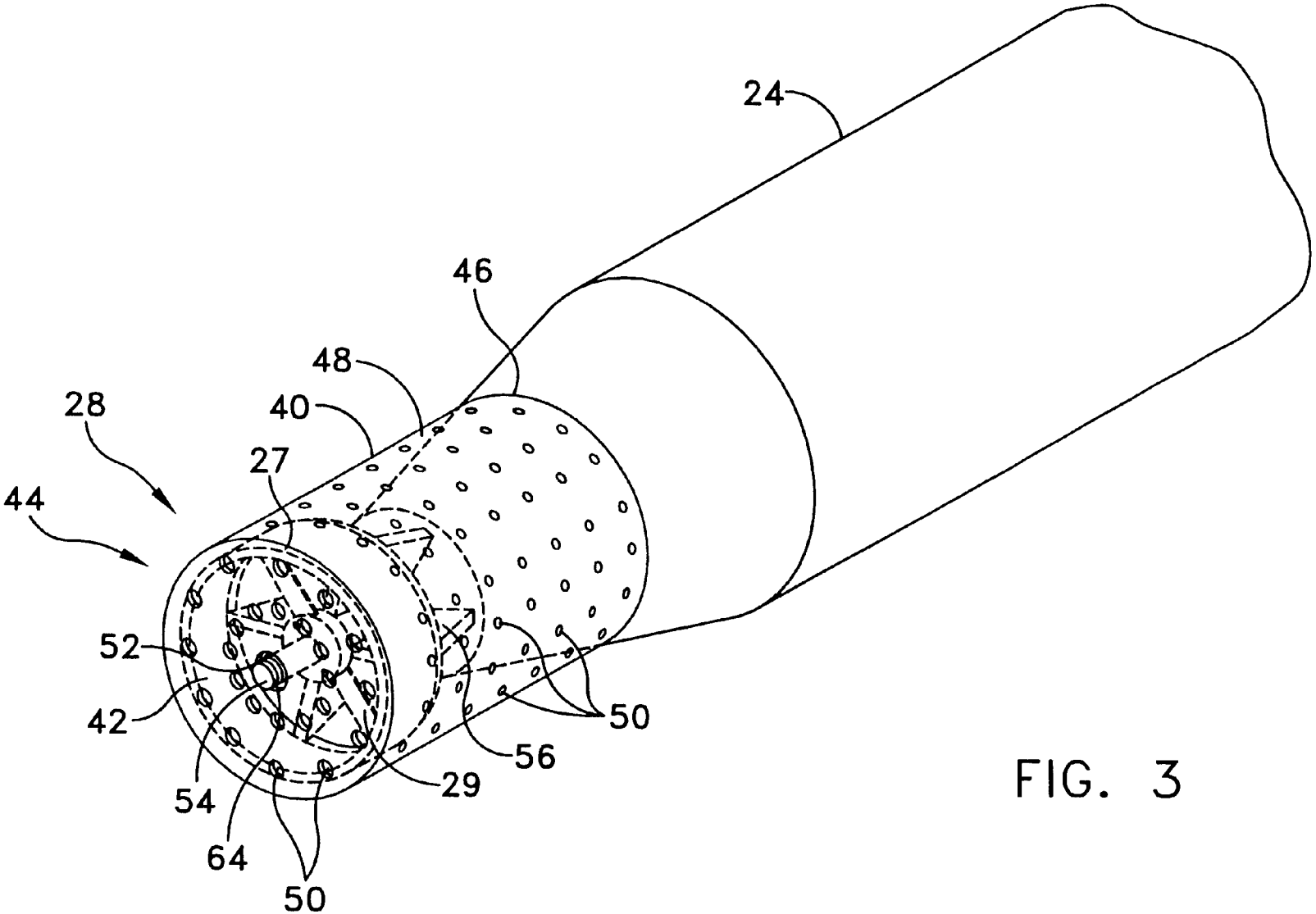
FIG. 3 is a perspective view similar to FIG. 2, but showing in addition one form of propeller protector illustrative of an embodiment of the invention, the propeller protector being shown as transparent for purposes of illustration.
Figure 4:
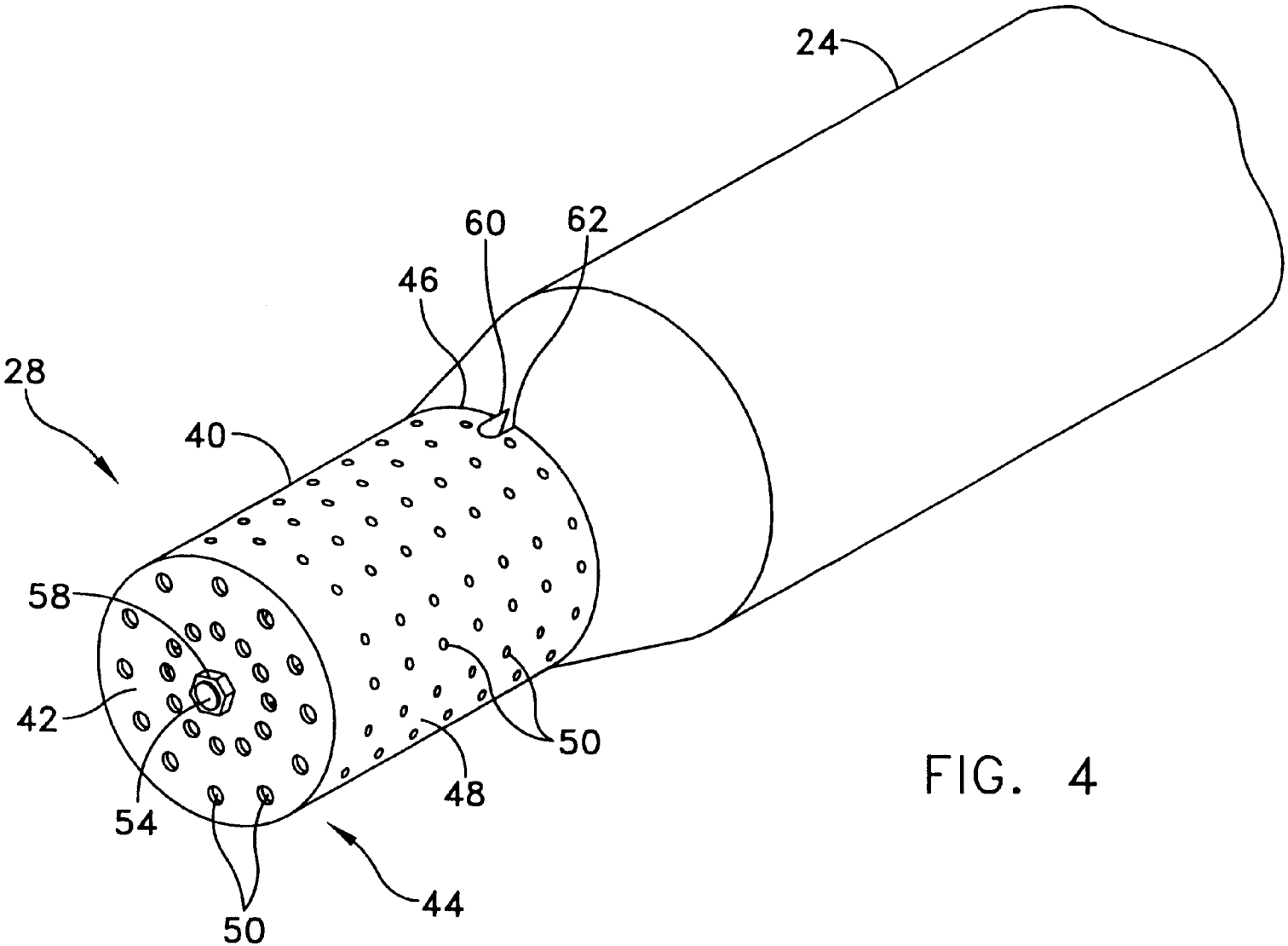
FIG. 4 is a perspective view similar to FIG. 3, but showing the propeller protector as it appears and additional features of the invention.

Referring to FIGS. 3 and 4, it will be seen that an illustrative embodiment of the invention includes a tubular sleeve 40 having an end wall 42 at a first end 44 thereof and an open second end 46 for engagement with the vehicle 24.

At least one, and preferably both, of the end wall 42 and side walls 48 of the sleeve 40 are provided with a multiplicity of perforations 50 therein, to permit the inflow of water, as will be further described hereinbelow. The end wall 42 is further provided with a central opening 52 (FIG. 3) through which extends a propeller shaft 54 to which the propeller 29 is fixed.

Fins 56 are mounted on the vehicle 24 and extend radially outwardly from the propeller shaft 54. The shield 27 is fixed to outer edges of the fins 56 and surrounds the propeller 29. The sleeve 40 fits over and around the shield 27 with the sleeve open end 46 engaged with the vehicle 24, and a threaded after end 64 (FIG. 3) of the propeller shaft 54 extends through the central opening 52 in the sleeve end wall 42.

A threaded nut 58 (FIG. 4) is fixed to the sleeve end wall 42 and is disposed around the end wall central opening 52 (FIG. 3) and is threadedly engaged with the propeller shaft threaded after end 64.

A stop structure 60, 62 (FIG. 4) is disposed on the sleeve open end 46 and the vehicle 24 to prevent the sleeve 40 from rotating relative to the vehicle 24, but to allow axial movement. The stop structure may include, for example, a detent 60 extending from the vehicle 24 and a slot 62 disposed in the sleeve 40 and configured to receive the detent 60. It will be apparent that the detent and slot can be reversed and accomplish the goal of preventing rotative movement between the vehicle and the sleeve, but permitting axial movement.

In operation, the vehicle 24 is launched from the launch tube 22 at a high rate of speed. In addition, the launching submarine may be proceeding at a high rate of speed and executing severe maneuvers, and strong currents athwartship to the submarine may be present. Upon emergence from the launch tube 22, the tailcone portion 28 of the vessel 24 is instantly subjected to all such forces. In accordance with the invention, the sleeve 40 permits water to flow to the propeller 29 but at a greatly reduced rate from the conventional onrush of water, protecting the propeller 29 from severe bending moments. In short order, the propeller shaft is activated and the shaft 54 and propeller 29 commence rotation. The turning of the shaft 54 unscrews the shaft from the nut 58 which is fixed to the sleeve end wall 42 which is held against rotation by the stop structure 60, 62. When the nut detaches from the shaft 54, the sleeve 40 is free to move axially, unhindered by the stop structure, and disengages from the vehicle 24, leaving the propeller 29 protected only by the shield 27, which is sufficient for post-launch environments.

There is thus provided an improved submarine countermeasure vehicle propeller protector which facilitates successful launch and deployment under conditions otherwise inflicting high bending moments on the propeller.

It will be understood that many additional changes in the details, materials, steps and arrangement of parts, which have been herein described and illustrated in order to explain the nature of the invention, may be made by those skilled in the art within the principles and scope of the invention as expressed in the appended claims.

What is claimed is:

1. A submarine countermeasure vehicle propeller protector comprising:

a tubular sleeve for disposal on an after end of the countermeasure vehicle and around a propeller thereof;

a forward end of said sleeve being open and adapted to engage an after portion of the countermeasure vehicle;

an after end of said sleeve having an end wall such that the propeller is substantially enclosed within said sleeve;

said sleeve having perforations therein; and said sleeve being releasably attachable to said countermeasure vehicle and adapted to self-release from said countermeasure vehicle upon deployment of said countermeasure vehicle and activation of the propeller.

2. The propeller protector in accordance with claim 1 wherein said sleeve is cylindrically shaped.

3. The propeller protector in accordance with claim 1 wherein the propeller is fixed to a propeller shaft extending from the vehicle and the propeller shaft is threadedly engaged with a nut fixed on the after end of said sleeve, wherein rotation of the shaft disengages the shaft from the nut to release said sleeve from the vehicle.

4. The propeller protector in accordance with claim 3 wherein said sleeve and the vehicle are provided with stop structure for preventing rotative movement between said sleeve and the vehicle but permitting axial movement therebetween.

5. The propeller protector in accordance with claim 4 wherein the stop structure comprises a detent and slot, the slot extending axially and the detent being adapted for disposition in the slot.

6. The propeller protector in accordance with claim 5 wherein the detent is disposed on a selected one of the vehicle and said sleeve, and the slot is disposed in the other of the vehicle and said sleeve.

7. The propeller protector in accordance with claim 1 wherein the perforations are disposed in side walls of said sleeve.

8. The propeller protector in accordance with claim 7 wherein the perforations are further disposed in the sleeve end wall.

9. The propeller protector in accordance with claim 1 wherein the perforations are disposed in the sleeve end wall.

10. A submarine countermeasure propeller protector for a countermeasure vehicle having on an after portion thereof a propeller shaft, a propeller fixed to the shaft, radial fins fixed on an after surface of the vehicle and extending outwardly from the shaft, and a shield fixed to outer edges of the fins and surrounding the propeller, the countermeasure propeller protector comprising:

a tubular sleeve having an end wall at a first end thereof, and an open second end adapted to be engaged with the vehicle;

at least one of the end wall and side walls of said sleeve having perforations therein;

the sleeve end wall having a central opening therein;

a nut fixed to the sleeve end wall and threadedly mounted on the shaft and disposed around the central opening; and stop structure on the sleeve second end and the vehicle to prevent rotation of said sleeve relative to the vehicle;

wherein rotation of the propeller shaft unscrews the shaft from said nut, permitting said nut and thereby said sleeve to move axially to disengage from the vehicle.

11. The propeller protector in accordance with claim 10 wherein the shield is of annular configuration and said sleeve is of cylindrical configuration and is adapted for disposition over and around the shield.

12. The propeller protector in accordance with claim 10 wherein the end wall and the side walls of the sleeve are provided with the perforations.

13. The propeller protector in accordance with claim 10 wherein the stop structure comprises a detent and slot, the slot extending axially and the detent being adapted for disposition in the slot.

14. The propeller protector in accordance with claim 13 wherein the detent is disposed on a selected one of the vehicle and said sleeve, and the slot is disposed in the other of the vehicle and said sleeve.

* * * * *